US009409737B2

(12) United States Patent
Vantrease

(10) Patent No.: US 9,409,737 B2
(45) Date of Patent: Aug. 9, 2016

(54) ENDLESS CLIP-STRIP FEED SPLICER

(71) Applicant: Joshua D. Vantrease, Selah, WA (US)

(72) Inventor: Joshua D. Vantrease, Selah, WA (US)

( * ) Notice: Subject to any disclaimer, the term of this patent is extended or adjusted under 35 U.S.C. 154(b) by 467 days.

(21) Appl. No.: 13/815,903

(22) Filed: Mar. 15, 2013

(65) Prior Publication Data

US 2014/0252155 A1 Sep. 11, 2014

Related U.S. Application Data

(63) Continuation-in-part of application No. 29/447,985, filed on Mar. 8, 2013, now Pat. No. Des. 707,553.

(51) Int. Cl.
*B65H 19/18* (2006.01)

(52) U.S. Cl.
CPC ..... *B65H 19/1868* (2013.01); *B65H 19/1831* (2013.01); *B65H 2301/41524* (2013.01); *B65H 2301/41525* (2013.01); *B65H 2301/4621* (2013.01); *B65H 2404/147* (2013.01); *B65H 2701/11332* (2013.01); *B65H 2701/191* (2013.01)

(58) Field of Classification Search
USPC ..... 242/555, 551, 554, 554.5, 554.6, 555.3, 242/555.1, 555.2, 556, 558, 560, 560.2
See application file for complete search history.

(56) References Cited

U.S. PATENT DOCUMENTS

| | | | | |
|---|---|---|---|---|
| 2,963,234 | A * | 12/1960 | Chase et al. | 242/421.7 |
| 3,164,249 | A | 1/1965 | Paxton | |
| 3,164,250 | A | 1/1965 | Paxton | |
| 3,270,874 | A | 9/1966 | Hilton | |
| 3,983,681 | A * | 10/1976 | Britt et al. | 53/76 |
| 4,026,413 | A | 5/1977 | Britt et al. | |
| 4,333,566 | A | 6/1982 | Holmes | |
| 4,341,303 | A | 7/1982 | Britt | |
| 4,361,935 | A | 12/1982 | Paxton | |
| D299,434 | S | 1/1989 | Burford | |
| 4,911,293 | A | 3/1990 | Holmes | |
| 6,228,205 | B1 * | 5/2001 | Rhodes et al. | 156/304.3 |
| 6,792,987 | B2 * | 9/2004 | Monroe | 156/351 |
| 6,841,020 | B2 * | 1/2005 | Hebels et al. | 156/157 |
| D539,140 | S | 3/2007 | Irwin | |
| 7,596,928 | B2 * | 10/2009 | Irwin | 53/417 |
| 8,163,118 | B2 | 4/2012 | Irwin et al. | |
| 8,261,513 | B2 * | 9/2012 | Irwin | 53/417 |
| 2004/0094451 | A1 * | 5/2004 | Saho | 206/714 |
| 2007/0278341 | A1 * | 12/2007 | Tsurunaga et al. | 242/554.2 |
| 2008/0230646 | A1 * | 9/2008 | Morelli et al. | 242/555.6 |
| 2010/0264248 | A1 * | 10/2010 | Butterworth | 242/552 |

* cited by examiner

*Primary Examiner* — Emmanuel M Marcelo
*Assistant Examiner* — Justin Stefanon
(74) *Attorney, Agent, or Firm* — Svendsen Legal, LLC.

(57) ABSTRACT

A splicer machine for feeding strips of closures or clips. The clips formed of flat plastic material, and for receiving portions of flexible bags. More specifically, the automated handling of strips of such clips, where strips of the clips are held together by interlocking portions of the clips.

17 Claims, 7 Drawing Sheets

ENDLESS CLIP-STRIP FEED SPLICER

TECHNICAL FIELD

This invention pertains to a machine for feeding strips of closures or clips. The clips formed of flat plastic material, and for receiving portions of flexible bags. More specifically, the invention relates to the automated handling of strips of such clips, where strips of the clips are held together by interlocking portions of the clips.

BACKGROUND OF THE INVENTION

'Bag-clip' types of closures are commonly used for holding closed the necks of flexible bags. Generally, these closure clips, also referred to as simply as 'closures,' 'clips,' or 'bag-clips,' are formed of semirigid flat, plastic material, and can be manufactured and handled in bulk as multi-closure strips of such clips, which can be separated by the automated breaking the connections between the adjacent clips of the strip, as each individual clip applied to a bag in succession. Conventionally, the individual clips in these strips are 'frangible' from adjoining, neighboring clips, in that they break apart easily to separate from the remaining strip of clips. These conventional clips have one or more 'tabs' or 'webs' that physically adjoin and interconnect each clip to the neighboring clip in the strip.

A difficulties occurs in the automated use of the clip-strips, in that the strips are not continuous and must be manually fed into machines that the clips to an article, such as a bag.

The following is a disclosure of the present invention that will be understood by reference to the following detailed description taken in conjunction with the accompanying drawings.

Figure 1:
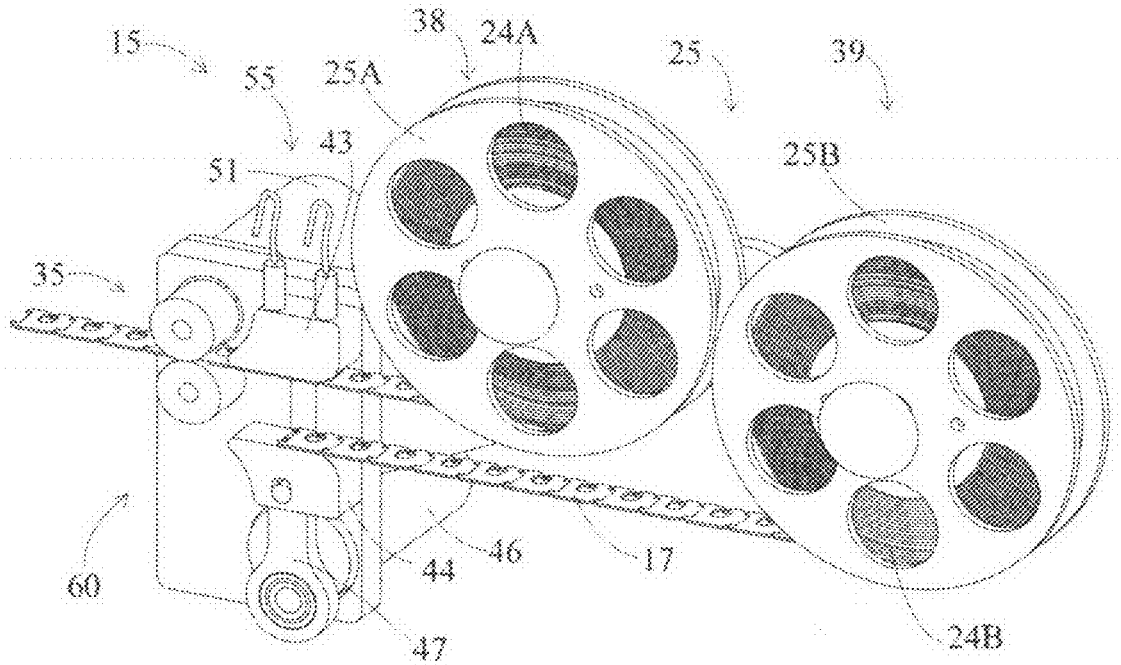
FIG. 1 is a perspective view of an endless clip-strip feed spicier, according to an embodiment of the invention.

Reference characters included in the above drawings indicate corresponding parts throughout the several views, as discussed herein. The description herein illustrates one preferred embodiment of the invention, in one form, and the description herein is not to be construed as limiting the scope of the invention in any manner. It should be understood that the above listed figures are not necessarily to scale and may include fragmentary views, graphic symbols, diagrammatic or schematic representations, and phantom lines. Details that are not necessary for an understanding of the present invention by one skilled in the technology of the invention, or render other details difficult to perceive, may have been omitted.

DETAILED DESCRIPTION OF SPECIFIC EMBODIMENTS

Figure 2:
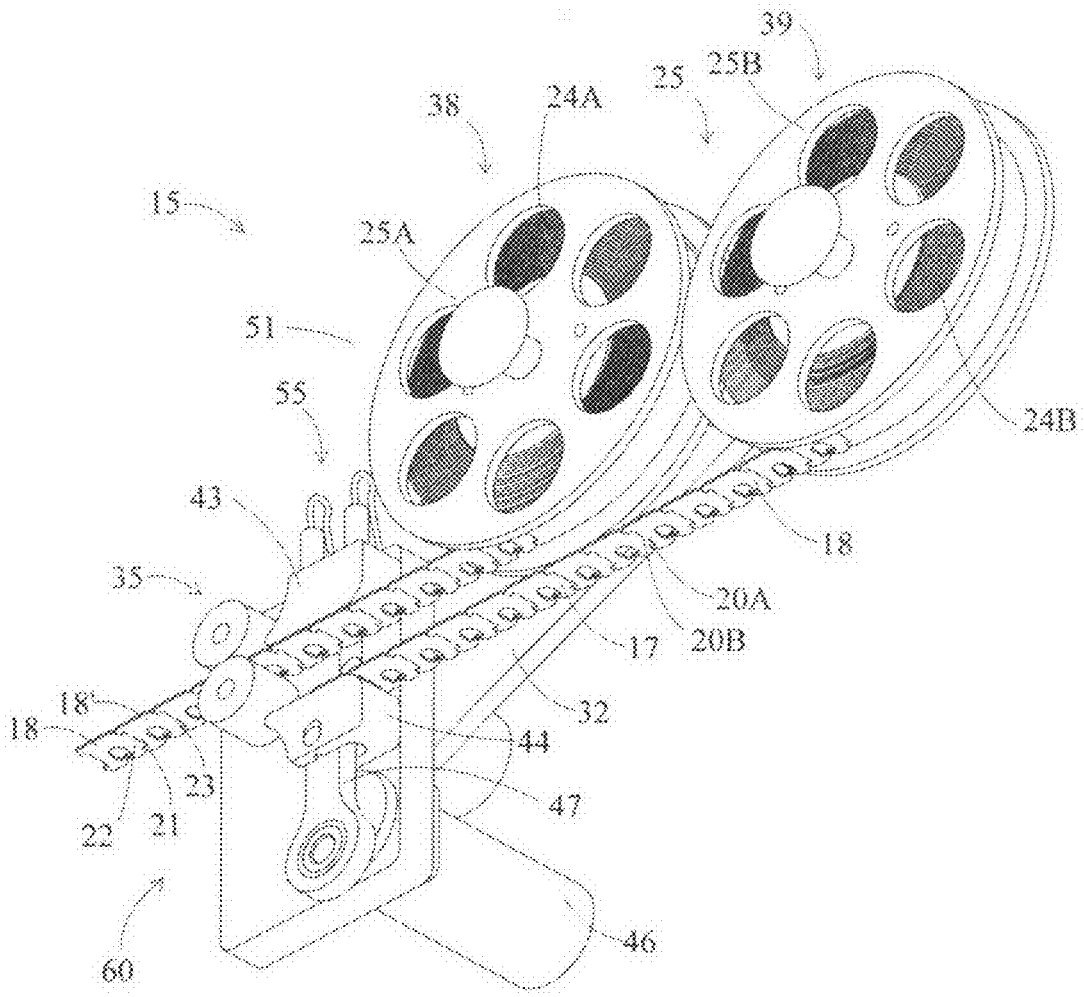
FIG. 2 is a perspective view of the endless clip-strip feed spicier, according to an embodiment of the invention.
Figure 3:
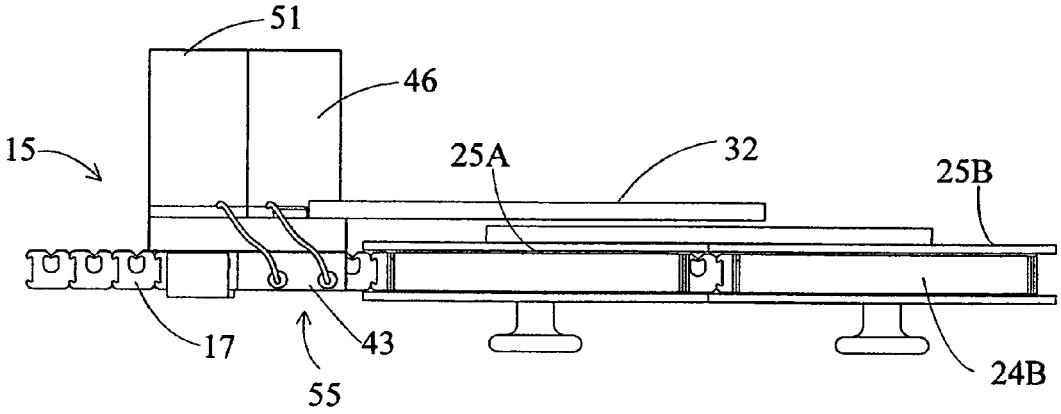
FIG. 3 is a top view of the endless clip-strip feed spicier, according to an embodiment of the invention.
Figure 4:
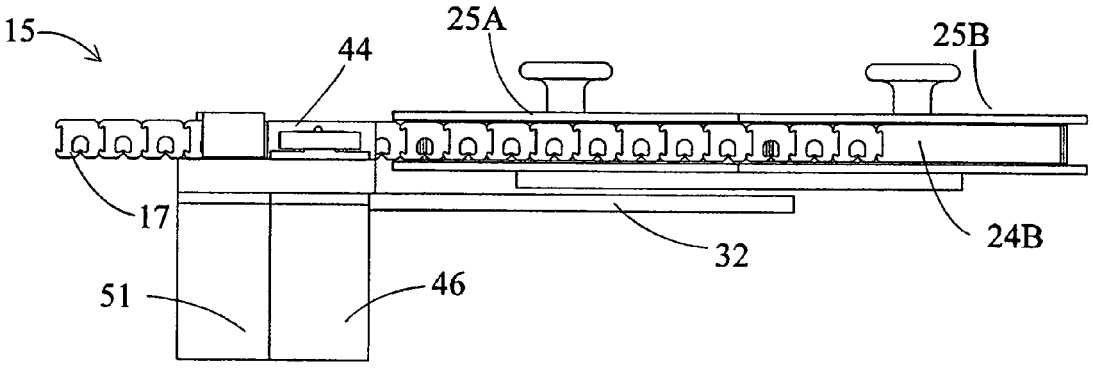
FIG. 4 is a bottom view of the endless clip-strip feed spicier, according to an embodiment of the invention.
Figure 5:
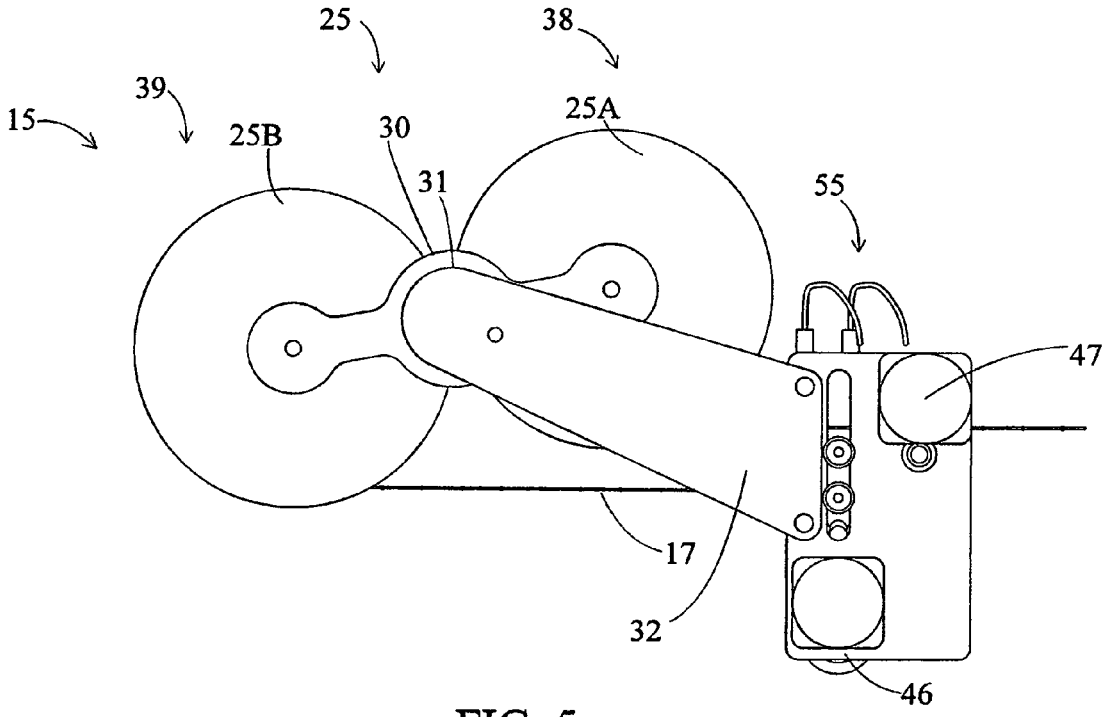
FIG. 5 is a back view of the endless clip-strip feed spicier, according to an embodiment of the invention.
Figure 6:
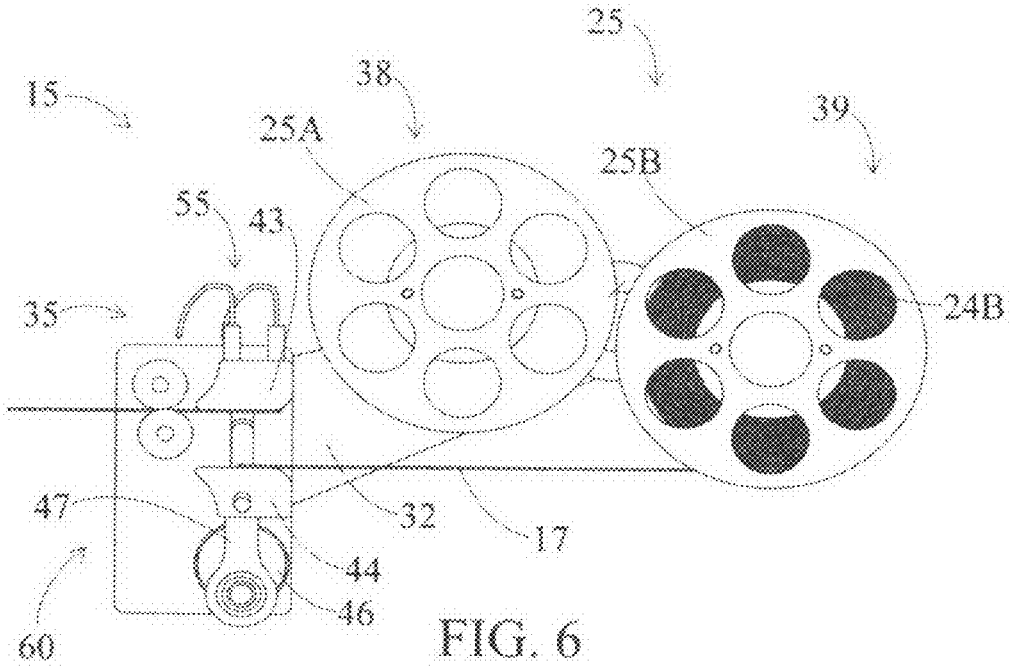
FIG. 6 is a front view of the endless clip-strip feed spicier, according to an embodiment of the invention.
Figure 7:
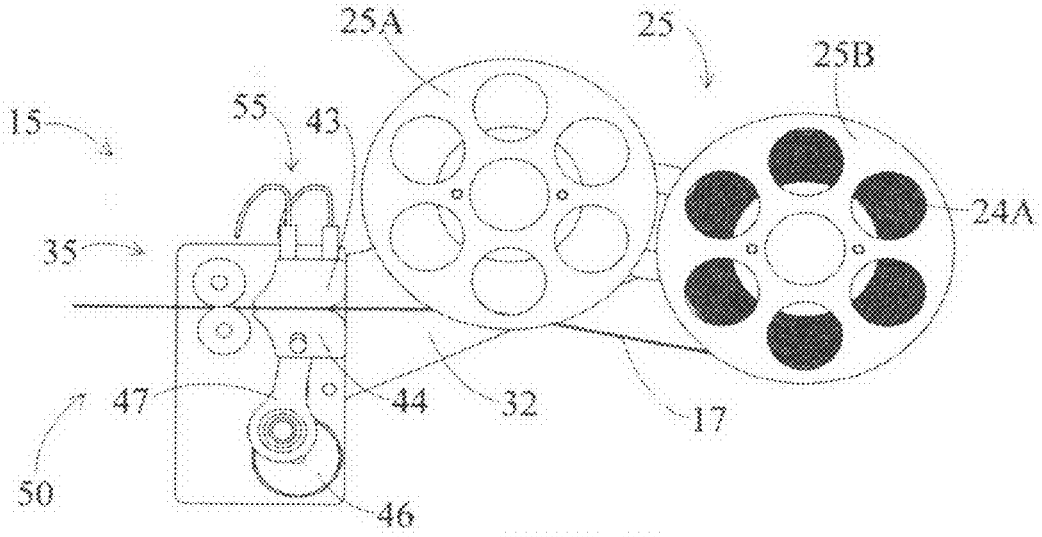
FIG. 7 is a second front view of the endless clip-strip feeder, according to an embodiment of the invention.

The present invention provides a clip-strip feed splicer, which serves as an endless clip-strip spicier and feeder of a strip of interlocking and interlock-able clips. The clip-strip feed splicer automatically couples rolls of clips together end to end without the need to halt the feed of the clips in a downstream use. FIGS. 1 through 10 show a preferred embodiment of the endless clip-strip feed splicer, which can be referred to herein simply as a 'splicer' 15. FIG. 1 illustrates the splicer processing a strip of clips or a 'clip-strip' 17, made up of a multiple of an interlock-able clip 18 The clips of the strip removably interlock together in series, as shown in FIGS. 1, 2, and 5. Each of the clips is typically formed of a flat material 19, such as a thin plastic sheet or strip of polystyrene or other conventional material, and is often used to attach to a bag, and more specifically to close a neck of a bag.

Each clip 18 of the clip-strip 17 includes a first interlock element 20A that is mate-able to a second interlock element 20B of a neighboring clip 18', to form the desired interlock 23 between the two clips. Preferably, the first interlock element is a pocket 21, received into a tab 22, which serves as the second element of the neighboring clip 18'. The interlock-able clip conserves space, as it is compact along the length of the clip-strip or in the preferred form of a clip-roll 24, as compared to prior multi-closure clips. Typically, these clip-strips are approximately 0.0032 inches in 'gauge' or thickness and, are packaged conventionally in rolls with approximately 4,000 clips per roll. The present invention eliminates the need to stop an automated clip applying process, such as bread-bagging, to change-out empty rolls of clips.

Additionally, the terms "approximately" or "approximate" are employed herein throughout, including this detailed description and the attached claims, with the understanding that is denotes a level of exactitude commensurate with the skill and precision typical for the particular field of endeavor, as applicable.

Figure 8:
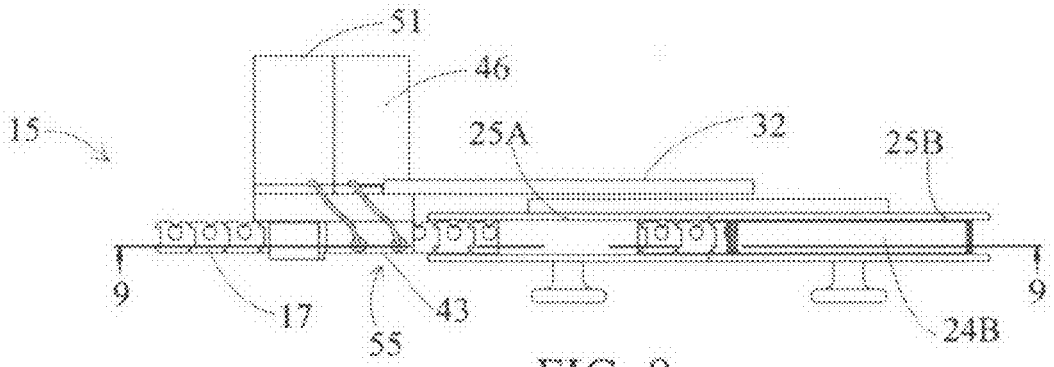
FIG. 8 is a second top view of the endless clip-strip feed spicier, according to an embodiment of the invention.
Figure 9:
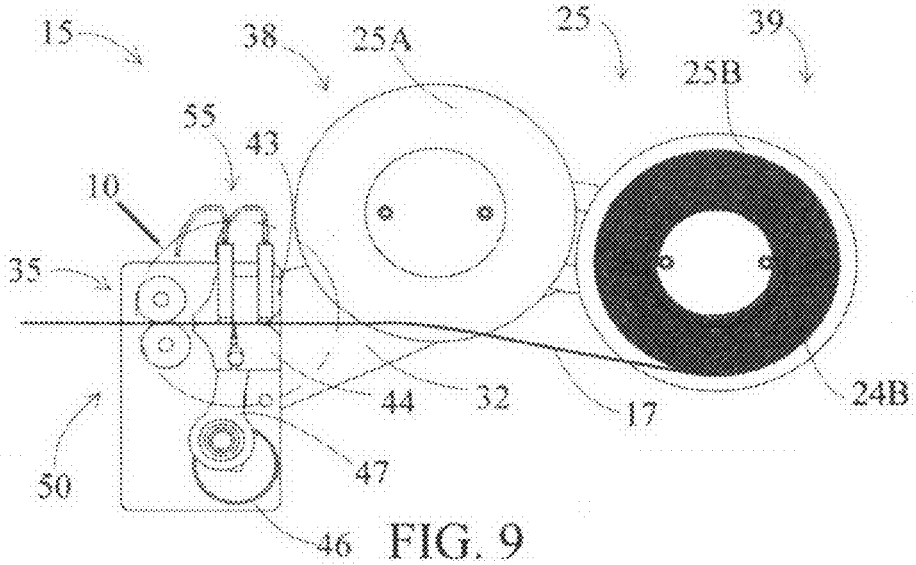
FIG. 9 is a front view of the endless clip-strip feed spicier sectioned along line 9-9 of FIG. 8, according to an embodiment of the invention.

As shown in FIG. 1 the splicer 15 includes the ability to hold two of the clip-rolls 24 on a pair of spools 25, namely a first clip-roll 24A received on a first spool 25A and a second clip-roll 24B, received on a second spool 25B, with each spool mounted to a toggle 30. The toggle is shown in FIG. 8, most preferably is a two lobed lever, mounted on a toggle arm 32 of the splicer 15. As an alternative, it is envisioned that a symmetric, three-lobed lever toggle could be employed, with a third roll held on a third spool held as a rotating reserve, waiting to cycle through the splicer, in turn.

The toggle 30 rotates about a toggle pivot 31, with the two spools alternating from a feed position 38 to a pre-stage position 39. Initially, the first clip-roll in the feed position on the first spool un-reels its clip-strip into the splicer 15, past a clamp mechanism 33 and through a pair of feed-rolls 35. The clamp mechanism includes a stationary block 43, preferably mounted above a moving block 44. The moving block cycles reciprocally up and down, by action of a clamp servo 46 that rotates a block rod 47, so that the moving block acts as a piston to clamp against the stationary block when the clamp servo rotates. The clamp servo is most preferably a electric servo-motor, or alternatively may be a conventional 'stepper motor.'

The pair of feed-rolls 35 primarily serve to pull the clip-strip 17 through the clamp mechanism 33, but preferably can also stop slow or reverse the clip strip, if desired. With the first clip-roll 24A feeding into the splicer 15 from the feed position 38, the second clip-roll is queued-up in the pre-stage position 39, with the first interlock element 20A leading from the second clip-roll 24B and positioned on the moving block and waiting for the last clip from the top roll to cycle into a clamping position 50 with the stationary block 43. The pair of feed rolls are preferably driven by a feed servo 51, which is most preferably a electric servo-motor, or alternatively may be a conventional 'stepper motor.'

Figure 10:
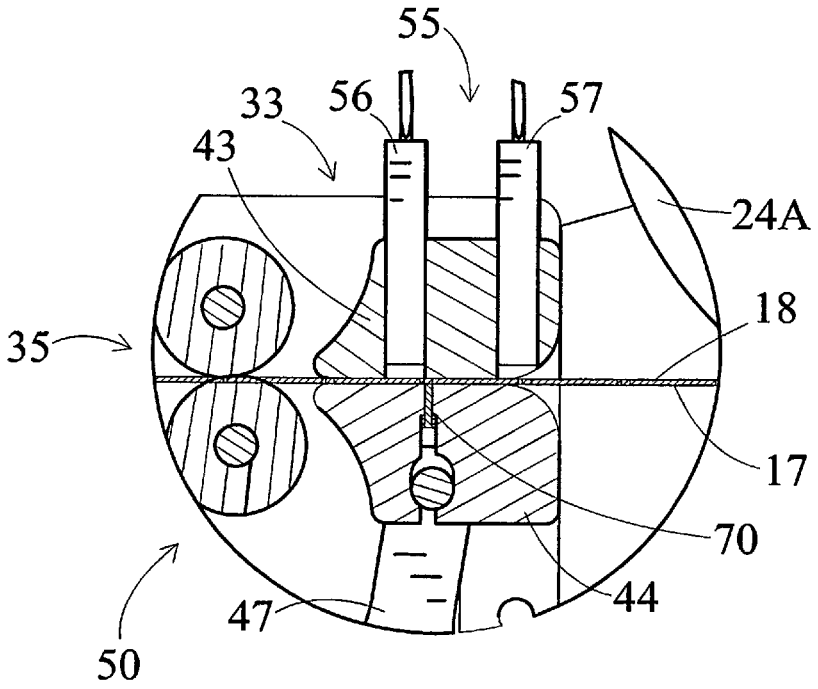
FIG. 10 is a perspective view of the endless clip-strip feed spicier of detail 10 of FIG. 9, according to an embodiment of the invention.

The clip-strip 17 from the first clip-roll 24A feeding from the feed position 38 into the clamp mechanism 33, is monitored by a clip-sensor 55. Primarily, the clip-sensor is employed to direct the clamp mechanism 33 operation of the splicer 15. Most preferably, the sensor is two-part and includes an end-roll detector 56 and a clip-end detector 57, as shown in FIG. 10. The sensors mount to the upper stationary block 43, near the pair of feed-rolls 35, as shown in FIGS. 1, 2, 3, 4, 6 and 7.

The end-roll detector 56 will sense the end of the first clip-roll 24B for the clip-strip 17 entering the clamp mechanism 33, and preferably will slow the pair of feed-rolls 35. The clip-end detector 57 then senses a more precise second interlock element 20B at the last clip of the first clip-roll. Most preferably, the pair of feed-rolls will reverse the feed of the clip-strip back toward the first spool 25A, still in the feed position 38 for a predetermined number of clips 18, which can be adjusted through use of a controller, which is most preferably a conventional programmable logic type of controller (PLC). This will allow the alignment of the remaining clip-strip from the first clip-roll to the incoming first interlock element 20A as mounted in the moving block 44, from the second spool 25A at the pre-stage position 39. Again, most preferably, the first interlock element of the interlock 23 is the pocket 21, with the pocket is used as the leading end of first clip of each clip-roll, as shown in FIG. 1, and also most preferably, the second interlock element of the interlock is the tab 22, with the tab used as the terminal end of last clip of each clip-roll To interlock the clips from the first clip-roll 24A to the second clip-roll 24B, the moving block 44 runs reciprocally to clamp with the stationary block 43, crating the interlock 23 between the first clip-roll and the second clip-roll. After clamping, the lower block returns to the a hold portion 60 at the bottom of its stroke, and the pair of feed rolls 35 resume pulling the clip-strips from the second clip-roll, which by rotation of the toggle 30 now travels to the feed portion, and so the second clip-roll becomes the first clip-roll and a replacement second clip-roll is placed on the second spool in the pre-stage position 39.

Preferably, spring loaded register 70 holds the lead clip of the second clip-roll in alignment on the moving block 44, as detailed in FIG. 10. Additionally, a low clip level detector can be employed for the pair of spools 25, to warn of a low number of clips on the first clip-roll 24A in the feed position 38. A flashing light can let the operator know when to have the next roll installed so not to interrupt the flow of clips downstream.

Therefore, the present invention is a significant improvement over conventional clip feeding processes, in that currently in the typical clip feeder process, an operator would need to replace a new clip-roll by hand, and clear any clips have not feed through a clip indexer. This interrupts the production flow at least every two hours, depending on the size of the clip-roll.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible, which employ the same inventive concepts as described above. Therefore, the invention is not to be limited except by the following claims, as appropriately interpreted in accordance with the doctrine of equivalents.

The following is claimed:

1. A clip-strip feed splicer, the splicer including:

a first clip-roll, having a continuous first clip-strip, received on a first spool and a second clip-roll, having a continuous second clip-strip received on a second spool, with the first spool and the second spool mounted to a lever, and the lever having a first lobe and a second lobe, the first spool mounted to the first lobe and the second spool mounted to the second lobe of the lever, and the lever rotatably mounted to a lever pivot on a lever arm, with the first spool and the second spool alternate-able from a feed position to a pre-stage position on the lever arm;

the first clip strip and the second clip strip including a multiple of interlock-able clips, the multiple of interlock-able clips removably interlock-able together in series, with each interlockable clip of the first clip strip and the second clip strip having a first interlock element and a second interlock element, the first interlock element interlockable to the second interlockable element of a neighboring interlockable clip; and the first clip-strip of the first spool initially in the feed position and the first clip-strip feed-able past a clamp mechanism, the second clip-roll initially queued-up in the pre-stage position, the clamp mechanism including a first block clamp-able against a second block, with the second interlock element trailing from the first clip-roll and the first interlock element leading from the second clip-roll positioned on the first block, and with the first block clamp-able with the second block to interlock the second interlock element of the first clip-roll to the first interlock element of the second clip-roll.

2. The clip-strip feed splicer of claim 1, wherein:

the lever able to rotate the second clip roll on the second spool to the feed position, and able to rotate the first spool to the pre-stage position.

3. The clip-strip feed splicer of claim 2, wherein:

after the lever rotates the second clip roll on the second spool to the feed position and the first spool to the pre-stage position, the second clip-roll becomes the first clip-roll and a replacement second clip-roll is place-able on the second spool in the pre-stage position.

4. The clip-strip feed splicer of claim 1, wherein:

a last interlockable clip from the first clip-strip of the first clip-roll locates within the clamping mechanism by the action of the first block to a clamping position against the second block, to interlock the last interlockable clip with a first interlockable clip from the second clip-strip of the second clip-roll; and after an interlock of the last interlockable clip with the first interlockable clip, the first block returns to the hold position, separate from the second block.

5. The clip-strip feed splicer of claim 4, wherein:

the first clip-strip from the first clip-roll fed from the first spool in the feed position into the clamp mechanism is monitored by a clip-sensor, the clip-sensor able to sense the last interlockable clip of the first clip-roll of the first clip-strip entering the clamp mechanism.

6. The clip-strip feed splicer of claim 5, wherein:

as an end-roll detector senses the end of the first clip-roll entering the clamp mechanism, a feed of the first clip-roll and the second clip-roll into the clamp mechanism is slowed for a more precise interlock between the last interlockable clip of the first clip-roll with the first interlockable clip of the second clip-roll.

7. The clip-strip feed splicer of claim 5, wherein:

the first clip-roll and the second clip-roll have a feed direction into the clamping mechanism, and the feed direction is reversed prior to the first block clamping against the second block, the reversing of the feed direction serving to align the second interlockable element on the last interlockable clip of the first clip-strip from the first clip-roll to the incoming first interlockable element of the first interlockable clip of the second clip-strip from the second clip-roll, on the first block.

8. The clip-strip feed splicer of claim 1, wherein:

the lever includes a third lobe, with a third clip-roll held on a third spool on the third lobe, the third spool held as a rotating reserve, the third clip-roll cycle-able through the clamping mechanism after the second clip-roll of the second spool, in turn.

9. The clip-strip feed splicer of claim 1, wherein:

the first block reciprocally cycles up and down by a rotational action of a clamp servo, the clamp servo rotationally reciprocating a block rod, with the block rod reciprocating against the first block, to clamp the first block against the second block when the clamp servo rotates.

10. The clip-strip feed splicer of claim 1, wherein:

the first block linearly travels up and down by action of a clamp servo, the clamp servo motor linearly actuating the first block to clamp the first block against the second block when the clamp servo linearly actuates the first block.

11. The clip-strip feed splicer of claim 1, wherein:

the first block linearly travels up and down by action of a stepper motor, the stepper motor linearly actuating the first block to clamp the first block against the second block when the stepper motor linearly actuates the first block.

12. A method for a clip-strip feed splicer, including the steps of:

a) mounting a first clip-roll on a first lobe of a lever, the first clip roll having a continuous first clip-strip received on a first spool, the first clip strip including a multiple of interlock-able clips, the multiple of interlock-able clips removably interlock-able together in series, with each interlockable clip of the first clip strip having a first interlock element and a second interlock element, the first interlock element interlockable to the second interlockable element of a neighboring interlockable clip;

b) mounting a second clip-roll on a second lobe of the lever, the second clip-roll having a continuous second clip-strip received on a second spool, the second clip strip including a multiple of interlock-able clips, the multiple of interlock-able clips removably interlock-able together in series, with each interlockable clip of the second clip strip also having the first interlock element and the second interlock element;

c) rotatably mounting the lever to a lever pivot on a lever arm, with the first spool and the second spool alternateable from a feed position to a pre-stage position on the lever arm;

d) feeding the first clip-strip past a clamp mechanism, the first clip-strip of the first spool initially in the feed position, and the clamp mechanism including a first block clamp-able against a second block to interlock to the first clip-roll to the second clip-roll, and the second clip-roll initially queued-up in the pre-stage position, with the first interlock element of the second clip-roll leading from the second clip-roll and positioned on the first block;

e) rotating the lever to move the second clip roll on the second spool to the feed position, and the first spool to the pre-stage position;

f) pulling the clip-strip with the pair of feed-rolls through the clamp mechanism feeding the first clip-roll into the splicer from the feed position;

g) queuing the second clip-roll in the pre-stage position, with the first interlock element leading from the second clip-roll and positioned on the first block and waiting for a last clip from the first clip-roll to move into a clamping position with the second block;

h) feeding the clip-strip from the first clip-roll from the feed position into the clamp mechanism;

i) mounting the first interlock element in the first block from the second spool;

j) aligning an out-going second interlock element of the clip-strip from the first clip-roll to an in-coming first interlock element of the clip-strip from the second clip-roll;

k) clamping the first block to the second block to interlock the out-going second interlock element from the first clip-roll to the in-coming first interlock element of the second clip-roll; and l) resuming the pulling of the clip-strips from the second clip-roll with the lever rotating to the feed position.

13. The method for a clip-strip feed splicer, of claim 12, additionally including the step of:

m) monitoring the clip-strip from the first clip-roll feeding from the feed position into the clamp mechanism with a clip-sensor, the clip-sensor having an end-roll detector and a clip-end detector.

14. The method for a clip-strip feed splicer, of claim 13, additionally including the step of:

n) mounting the end-roll detector and the clip-end detector to the second block, near the pair of feed-rolls; and o) sensing the second interlock element of the last clip of the first clip-roll entering the clamp mechanism with the end-roll detector.

15. The method for a clip-strip feed splicer, of claim 12, additionally including the steps of:

m) rotating the first spool on the first lobe of the lever to the pre-stage position after the step of clamping the first block to the second block to interlock the out-going second interlock element from the first clip-roll to the in-coming first interlock element of the second clip-roll, with the second clip-roll becoming the first clip-roll; and n) replacing an empty first spool on the first lobe of the lever with a new second clip-roll on a new second spool, in the pre-stage position.

16. The method for a clip-strip feed splicer, of claim 12, additionally including the steps of:

m) reversing a feed of the first clip-strip from the first clip-roll into the clamping mechanism back into the first spool for a predetermined number of clips; and n) aligning the out-going second interlock element from the first clip-roll to the incoming first interlock element of the second clip-roll, as mounted in the first block.

17. The method for a clip-strip feed splicer, of claim 16, additionally including the step of:

o) adjusting the reversing of the feed for a predetermined number of clips with a programmable logic controller, to better align the out-going second interlock element from the first clip-roll with the incoming first interlock element of the second clip-roll.

* * * * *